United States Patent [19]

Ward et al.

[11] Patent Number: 4,616,195

[45] Date of Patent: Oct. 7, 1986

[54] COAXIAL PHASE SHIFTER FOR TRANSVERSE ELECTROMAGNETIC TRANSMISSION LINE

[75] Inventors: Robert D. Ward, Manhattan Beach; Frank A. Taormina, Glendale; Mon N. Wong, Torrance, all of Calif.

[73] Assignee: Hughes Aircraft Company, Los Angeles, Calif.

[21] Appl. No.: 709,878

[22] Filed: Mar. 8, 1985

[51] Int. Cl.[4] ..... H01P 1/18

[52] U.S. Cl. ..... 333/160; 333/24 C; 333/156; 333/245

[58] Field of Search ..... 333/156, 157, 160, 164, 333/236, 243, 244, 245, 263, 24 C, 27, 202, 206, 207, 159

[56] References Cited

U.S. PATENT DOCUMENTS

| | | | |
|---|---|---|---|
| 3,443,244 | 5/1969 | Cook | 331/96 |
| 4,032,920 | 6/1977 | Martin, Jr. et al. | 343/413 |
| 4,088,970 | 5/1978 | Fassett et al. | 333/150 |
| 4,365,214 | 12/1982 | Shillady | 333/33 |

OTHER PUBLICATIONS

Matthaei et al.-"Microwave Filters, Impedance Matching Networks and Coupling Structures", McGraw-Hill, New York, copyright 1964; pp. 360-364.

Ghirardi-"Radio Physics Course", Radio and Technical Publishing Co. New York City, Jun. 1937; pp. 196-198.

"A Class of Minimum-Phase Microwave Filters with Simultaneous Conditions on Amplitude and Delay", S. O. Scanlan, IEEE Transactions on Microwave Theory and Techniques, vol. MTT-19, No. 9, Sep. 1971.

"Coaxial Bandpass Filter Design", W. A. Davis, IEEE Transactions on Microwave Theory and Techniques, vol. MTT-19, No. 4, Apr. 1971.

"Design Procedure for Coaxial, High-Pass Filters", Glyn Bostick, Electronic Design, Apr. 13, 1960.

"The Practical Realization of Series-Capacitive Couplings for Microwave Filters", Leo Young, Stanford Research Institute, The Microwave Journal Dec. 1962.

"A Synthesis Procedure for Transmission Line Networks", A. I. Grayzel, IRE Transactions on Circuit Theory.

*Primary Examiner*—Marvin L. Nussbaum

*Attorney, Agent, or Firm*—J. A. Sawyer, Jr.; M. J. Meltzer; A. W. Karambelas

[57] ABSTRACT

A coaxial phase shifter for shifting the phase of a signal being transmitted along a transverse electromagnetic transmission line. The phase shifter is in line with the transmission line's inner conductor, such that it is very compact and such that the transmission line's outer conductor need not be modified. The phase shifter includes electrically-conductive fingers arranged in spaced, confronting relationship with each other, to capacitively couple the signal from one segment of the transmission line's inner conductor to another. In addition, the phase shifter is configured to provide an input impedance at both of its ends that matches the characteristic impedance of the transmission line.

18 Claims, 5 Drawing Figures

COAXIAL PHASE SHIFTER FOR TRANSVERSE ELECTROMAGNETIC TRANSMISSION LINE

BACKGROUND OF THE INVENTION

This invention relates generally to phase shifters, and, more particularly, to phase shifters of the kind that are aligned with the inner conductor of a transverse electromagnetic (TEM) transmission line.

It is frequently necessary to shift the phase of signals being transmitted along a TEM transmission line. Equalizing the signals output by a hybrid coupler, for example, usually requires a differential phase shifting of one output branch. In the past, phase shifting of this kind has sometimes been provided by incorporating an excess line length in a particular one of the output branches. This is not an entirely satisfactory technique, however, because an excess line length is dispersive, i.e., it provides a phase shift that is directly proportional to frequency.

Other phase shifters of this kind used in the past have included elements that are not aligned with the transmission line. Although generally effective at shifting the phase of the transmitted signal, without introducing excessive dispersion, such phase shifters are believed to be excessively bulky. In addition, these phase shifters require modification of both the inner and outer conductors of the transmission line.

It should be appreciated that there is a need for a phase shifter for use in a TEM transmission line, which is aligned with the line's inner conductor, such that the outer conductor can remain unmodified, and which provides convenient selection of the amount of phase shifting, while providing low dispersion. The present invention fulfills this need.

SUMMARY OF THE INVENTION

The present invention is embodied in a compact, coaxial phase shifter for use in shifting the phase of a signal being transmitted along a transverse electromagnetic (TEM) transmission line. The transmission line includes coaxial inner and outer conductors, and a dielectric, preferably air or a vacuum, located between the two conductors. The phase shifter of the invention interconnects and capacitively couples together first and second segments of the inner conductor and it is in line with the inner conductor, to provide a very compact structure. In addition, the phase shifter provides a selected phase shift of the transmitted signal, with very low dispersion.

More particularly, the phase shifter of the invention includes first means electrically connected to the first inner conductor segment and second means electrically connected to the second inner conductor segment. The first and second means both include finger means that are positioned in spaced, confronting relationship with each other, so as to form a capacitive coupling between the two means. An insulating sheath encircles and secures together the first and second means in their predetermined aligned relationship.

The first and second means both have cross sections that are smaller in size than that of the adjacent TEM line's inner conductor. The sheath, which encircles the first and second means, compensates for their reduced cross section and has an outside dimension preferably substantially equal to that of the inner conductor. The overall length of the first and second means, and of the encircling sheath, is substantially equal to one-half the signal wavelength, and the distance from the base of the first finger means to the base of the second finger means is substantially equal to one-fourth the signal wavelength. This configuration provides impedance matching, such that the phase shifter has an input impedance at both ends that is substantially the same as the transmission line's characteristic impedance.

In one form of the invention, the center and outer conductors of the transmission line both have square cross sections. The first finger means includes a single finger aligned with the centerline of the inner conductor, and the second finger means includes two fingers, located on opposite sides of, and equally spaced from, the single finger of the first finger means. The capacitive coupling is, of course, provided by the confronting surfaces of the respective fingers. The fingers preferably have rectangular cross sections that are substantially uniform along their entire lengths. The degree of capacitive coupling between the respective fingers is selected by modifying the widths of the fingers' confronting surfaces. The maximum width corresponds to the width of the remaining portions of the first and second means.

In an alternative form of the invention, the first finger means can further include two additional fingers sized the same as, and axially aligned with, the two fingers of the second finger means. These additional fingers are substantially shorter than the first finger and function to be engaged by the insulating sheath and thereby assist the securing together of the first and second means in their aligned positions.

The insulating sheath can conveniently include two U-shaped channel sections extending the entire length of, and located on opposite sides of, the first and second means. When in place, these two channel sections secure the first and second means in alignement with each other, thus ensuring a uniform capacitive coupling and phase shifting.

Other aspects and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENT

As shown in the illustrative drawings, the present invention is embodied in a compact, coaxial phase shifter 11 for use in shifting the phase of a signal being transmitted along a tranverse electromagnetic (TEM) transmission line 13. The TEM line has a square cross section and includes an inner conductor 15, a coaxial outer conductor 17, and an air or vacuum dielectric located between the two conductors. The phase shifter is in line with the inner conductor, and the outer conductor need not be modified, whereby the phase shifter has a very compact and non-complex structure. The phase shifter capacitively couples a left section 15*a* with a right section 15*b* of the inner conductor, so as to shift the phase of the transmitted signal by a selected amount. In addition, the phase shifter provides a dispersion, i.e., change in phase shift with frequency, that is significantly less than that of a phase shifter in the form of a transmission line of excess length.

Figure 1:
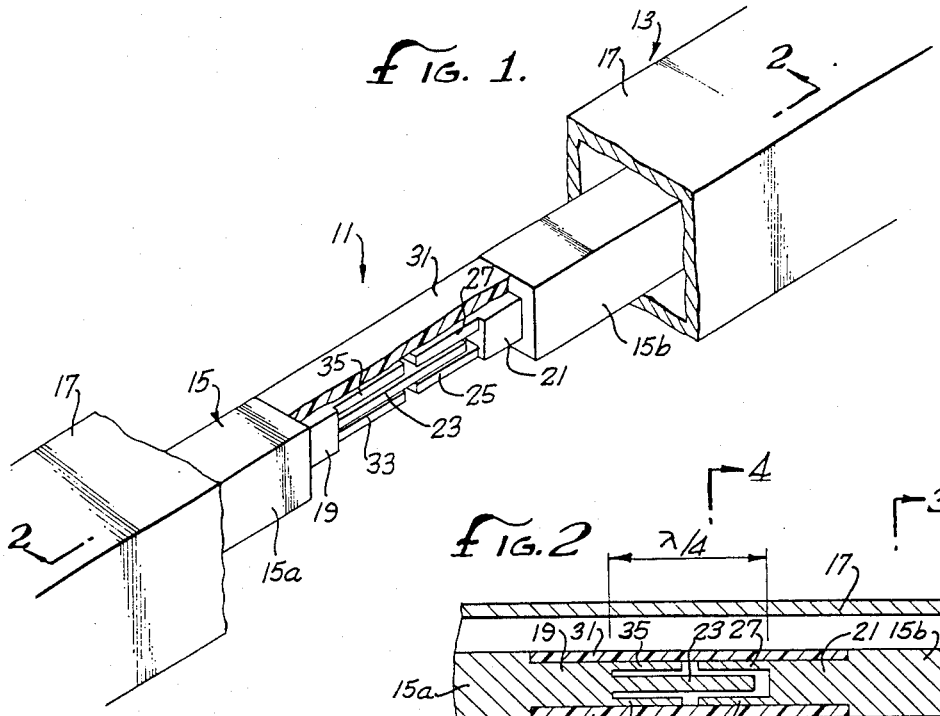
FIG. 1 is a perspective view of one embodiment of the coaxial phase shifter of the invention, shown with the squarax transmission line's outer conductor and the insulating sheath being broken away to reveal the phase shifter's inner structure.
Figure 2:
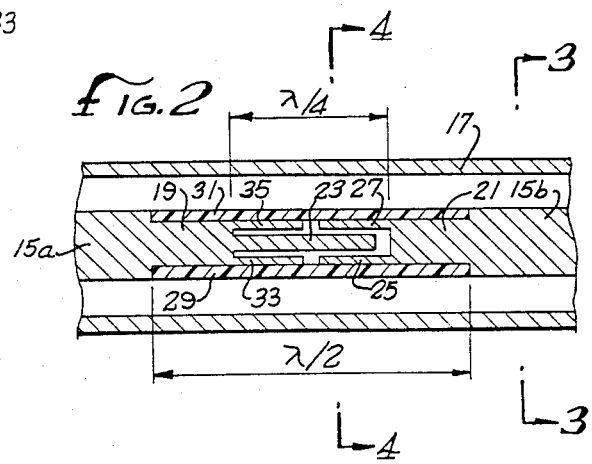
FIG. 2 is a side sectional view of the coaxial phase shifter, taken in the direction of the arrows 2—2 in FIG. 1.
Figure 3:
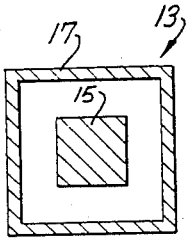
FIG. 3 is a sectional view of the squarax transmission line used with the coaxial phase shifter of the invention, the view being taken in the direction of the arrows 3—3 in FIG. 2.

With particular reference to FIGS. 1 and 2, the phase shifter 11 includes a left segment 19 electrically connected to the left section 15*a* of the inner conductor, and a right segment 21 electrically connected to the right section 15*b* of the inner conductor. The left segment includes a single finger 23 projecting to the right and aligned with the centerline of the inner conductor. The right segment 21, on the other hand, includes two fingers 25 and 27 projecting to the left and located on opposite, confronting sides of the first finger 23. All of the fingers have uniform rectangular cross sections and the space between their confronting surfaces is uniform and filled with an air or vacuum dielectric.

The cross sections of the phase shifter's left and right segments 19 and 21, respectively, are square, but smaller in size than the respective left and right inner conductor sections 15*a* and 15*b*. The overall length of the phase shifter is substantially equal to one half the wavelength of the transmitted signal in the transmission line. This is substantially the same as one half of the signal's free space wavelength, since the transmission line's dielectric is either air or a vacuum. In addition, the overall length of the confronting fingers 23, 25 and 27, i.e., from the base of the first finger 23 to the adjacent bases of the two fingers 25 and 27, is substantially equal to one quarter the wavelength of the transmitted signal.

This configuration provides an impedance match with the transmission line, with a low voltage standing wave ratio. In particular, the phase shifter's input impedance at both of its ends is substantially the same as the line's characteristic impedance, e.g., 50 ohms. The mismatching created by the capacitive interface and the stepped cross sections is substantially eliminated by turning the lengths of the various elements, as described above. The capacitively-coupled fingers 23, 25 and 27 are believed to be generally equivalent to a single discontinuity located approximately at the phase shifter's midpoint, one-quarter wavelength from the two ends.

The respective left and right segments 19 and 21 of the phase shifter 11 are rigidly held in their predetermined aligned positions by an insulating sheath that includes two U-shaped channels 29 and 31. These channels fit snugly around the left and right segments 19 and 21. including their respective fingers 23, 25 and 27. The inside dimensions of the two channels correspond with the outside dimensions of the left and right segments, and the outside dimensions of the two channels correspond with the dimensions of the transmission line's inner conductor sections 15*a* and 15*b*. Thus, when the phase shifter is assembled, it is sized just like a segment of the inner conductor. The phase shifting therefore can occur without the need for any modification to the transmission line's outer conductor 17.

By securing the two segments 19 and 21 of the phase shifter 11 in their prescribed aligned locations using a sheath 29 and 31 that encircles the segments, the gaps beween the confronting fingers 23, 25 and 27 can have an air or vacuum dielectric. This is advantageous because the space between the fingers is where the strongest electromagnetic field is present. The two channels of the sheath are preferably formed of a suitable insulating material such as Rexolite.

To assist the firm gripping of the respective left and right segments 19 and 21 of the phase shifter 11 by the sheath's two U-shaped channels 29 and 31, the left segment further includes two additional fingers 33 and 35 projecting to the right, in alignment with the two fingers 25 and 27, respectively, of the right segment. These two additional fingers 33 and 35 have substantially the same cross sectional size and shape of the other two fingers 25 and 27, and are of approximately the same length. A small gap between the remote ends of these corresponding fingers is thus located at the approximate midpoint of the phase shifter. The two U-shaped channels therefore have a substantially equal grip on the two segments 19 and 21.

Figure 4:
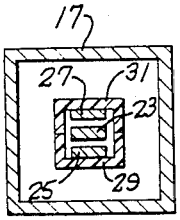
FIG. 4 is a sectional view of the coaxial phase shifter, taken in the direction of the arrows 4—4 in FIG. 2.

With particular reference to FIGS. 1 and 4, it will be observed that the finger 23 of the left segment 19 and the fingers 25 and 27 of the right segment 21 are somewhat narrower in width than the base portions of the corresponding segments. This dimension can be selectively varied to provide a desired amount of capacitive coupling between the respective fingers, and thereby provide a desired amount of phase shifting of the signal being transmitted. Maximum coupling, of course, occurs when the fingers occupy the full width available. The capacitive coupling also can be selected by varying the size of the gaps between the confronting surfaces of the fingers.

Figure 5:
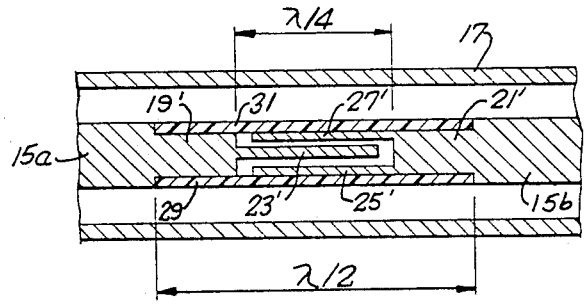
FIG. 5 is a sectional view similar to that of FIG. 2, but of an alternative embodiment of the coaxial phase shifter of the invention.

In an alternative embodiment, depicted in FIG. 5, the left segment 19' of the phase shifter 11 does not include any additional fingers. In this embodiment, the two fingers 25' and 27' projecting to the left from the right segment 21' extend well beyond the approximate midpoint of the phase shifter and terminate just short of the base of the finger 23' for the left segment. This embodiment provides additional capacitive coupling between the two segments, and is suitable in situations where additional phase shifting is desired.

Phase shifts on the order of 60 to 90 degrees are readily provided by just a single phase shifter 11 of the kind described above. If a greater phase shift is desired, two or more separate phase shifters may be cascaded with each other.

It should be appreciated from the foregoing description that the present invention provides an improved phase shifter for use with a TEM transmission line. The phase shifter is in line with the transmission line's inner conductor, such that it is very compact and such that the transmission line's outer conductor need not be modified. The phase shifter is configured to provide an impedance match with the transmission line, with both of its ends having substantially the same input impedance as the line's characteristic impedance.

Although the present invention has been described in detail with reference to the presently-preferred embodiments, it will be appreciated by those of ordinary skill in the art that various modifications can be made without departing from the invention. Accordingly, the invention is defined only by the following claims.

We claim:

1. A coaxial phase shifter for use in shifting the phase of a signal being transmitted along a transverse electromagnetic transmission line of the kind including an inner conductor, a coaxial outer conductor, and a dielectric located between the conductors, wherein the coaxial phase shifter is in line with the inner conductor and it interconnects a first segment of the inner conductor with a second segment of the inner conductor, the coaxial phase shifter comprising:

first means electrically connected to the first segment of the inner conductor of the transmission line, the first means having a cross section less than that of the inner conductor and including finger means projecting alolng the axis of the transmission line:

second means electrically connected to the second segment of the inner conductor of the transmission line, the second means having a cross section less than that of the inner conductor and including finger means projecting along the axis of the transmission line;

wherein the first and second means are positioned with their respective finger means in spaced, confronting relationship with each other, such that the first and second means cooperate to form a capacitive coupling between the first and second segments of the inner conductor of the transmission line; and an insulating sheath encircling and securing together the first and second means in their predetermined aligned relationship, whereby the coaxial phase shifter shifts the phase of the signal being transmitted along the transmission line by a predetermined amount.

2. A coaxial phase shifter as defined in claim 1, wherein:

the signal being transmitted along the transmission line has a nominal wavelength; and the overall length of the first and second means, and of the encircling sheath, is substantially equal to one-half the signal's nominal wavelength.

3. A coaxial phase shifter as defined in claim 2, wherein the distance from the base of the finger means of the first means to the base of the finger means of the second means is substantially equal to one-fourth the signal's nominal wavelength.

4. A coaxial phase shifter as defined in claim 1, wherein:

the inner and outer conductors of the transmission line both have square cross sections;

the dielectric of the transmission line is either air or a vacuum;

the finger means of the first means includes a single finger aligned with the centerline of the inner conductor; and the finger means of the second means includes two fingers, located on opposite sides of, and equally spaced from, the single finger of the first means.

5. A coaxial phase shifter as defined in claim 4, wherein the fingers of the respective first and second means have cross sections that are substantially uniform along their entire lengths.

6. A coaxial phase shifter as defined in claim 5, wherein the confronting surfaces of the fingers of the respective first and second means have uniform widths that are smaller in size than the widths of the remaining portions of the first and second means.

7. A coaxial phase shifter as defined in claim 5, wherein the finger means of the first means further includes two additional fingers sized the same as, and axially aligned with, the two fingers of the finger means of the second means, the two additional fingers being substantially shorter than the single finger and functioning to be engaged by the insulating sheath and thereby assist the securing together of the first and second means.

8. A coaxial phase shifter as defined in claim 1, wherein:

the insulating sheath includes two U-shaped channels extending the entire length of, and located on opposite sides of, the first and second means; and the outside dimensions of the insulating sheath are substantially the same as the outside dimensions of the inner conductor of the transmission line.

9. A coaxial phase shifter as defined in claim 1, wherein the respective finger means of the first and second means are spaced a uniform distance apart from each other, and an air or vacuum dielectric is provided therebetween.

10. A coaxial phase shifter as defined in claim 1, wherein the first means, second means, and insulating sheath are configured to provide the phase shifter with an input impedance at both of its ends that substantially matches the characteristic impedance of the transmission line.

11. A method of providing a selected phase shifting of a signal being transmitted along a tranverse electromagnetic transmission line of the kind including an inner conductor, a coaxial outer conductor, and an air or vacuum dielectric located between the conductors, the inner and outer conductors both having square cross sections, the method including steps of;

providing a phase shifter in line with the inner conductor of the transmission line, the phase shifter capacitively coupling together a first segment and a second segment of the inner conductor by means of first finger means electrically connected to the first inner conductor segment and second finger means electrically connected to the second inner conductor segment, the first and second finger means having surfaces positioned in spaced, confronting relationship with each other to form the capacitive coupling;

wherein the first finger means includes a single finger aligned with the centerline of the inner conductor and the second finger means includes two fingers, located on opposite sides of, and equally spaced from, the single finger of the first finger means; and selectively varying the respective sizes of the spaced, confronting surfaces of the first and second finger means, to correspondingly vary the capacitive coupling and thus the amount of phase shift the phase shifter provides for the transmitted signal.

12. A mehtod as defined in claim 11, wherein the step of selectively varying includes a step of varying the widths of the respective fingers of the first and second finger means, in a direction transverse to the transmission line's axis.

13. A coaxial phase shifter for use in shifting the phase of a signal being transmitted along a transverse electromagnetic transmission line of the kind including coaxial inner and outer conductors and an air or vacuum dielectric located between the conductors, wherein the phase shifter is in line with the inner conductor and it capacitively couples together first and second segments of the inner conductor, the coaxial phase shifter comprising:

first means electrically connected to the first inner conductor segment, the first means having a cross section less than that of the inner conductor and including a first finger projecting along the axis of the transmission line, aligned with the centerline of the inner conductor;

second means electrically connected to the second inner conductor segment, the second means having a cross section less than that of the inner conductor and including second and third fingers projecting along the axis of the transmission line, on opposite sides of, and spaced uniformly from, the first finger, the confronting surfaces of the respective first, second and third fingers providing a capacitive coupling between the first and second means, and thus the first and second inner conductor segments; and an insulating sheath encircling and securing together the first and second means in their predetermined, aligned relationship, wherein the phase shifter is configured to have an input impedance at both of its ends that substantially matches the characteristic impedance of the transmission line.

14. A coaxial phase shifter as defined in claim 13, wherein:

the signal being transmitted along the transmission line has a nominal wavelength; and the overall length of the first and second means, and of the encircling sheath, is substantially equal to one-half the signal's nominal wavelength

15. A coaxial phase shifter as defined in claim 14, wherein the distance from the base of the first finger to the adjacent bases of the second and third fingers is substantially equal to one-fourth the signal's nominal wavelength.

16. A coaxial phase shifter as defined in claim 13, wherein:

the inner and outer conductors of the transmission line both have square cross sections; and the first, second and third fingers all have rectangular cross sections that are substantially uniform along their entire lengths.

17. A coaxial phase shifter as defined in claim 16, wherein the confronting surfaces of the first, second and third fingers have uniform widths that are selected to be smaller in size than the widths of the remaining portions of the first and second means, to provide a desired amount of capacitive coupling between the first and second inner conductor segments.

18. A coaxial phase shifter as defined in claim 13, wherein:

the insulating has an outside dimension substantially the same as that of the inner conductor; and the insulating sheath includes two U-shaped channel sections extending the entire length of, and located on opposites of, the first and second means.

* * * * *